US009745653B2

(12) United States Patent
Schaffrath et al.

(10) Patent No.: US 9,745,653 B2
(45) Date of Patent: Aug. 29, 2017

(54) APPARATUS FOR THE CONTINUOUS HOT-DIP COATING OF METAL STRIP

(71) Applicant: THYSSENKRUPP STEEL EUROPE AG, Duisburg (DE)

(72) Inventors: Norbert Schaffrath, Hamm (DE); Thorsten Müller, Duisburg (DE); Friedhelm Macherey, Alpen (DE); Gernot Nothacker, Dortmund (DE); Tim Rübenstrunk, Dortmund (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 204 days.

(21) Appl. No.: 14/787,216

(22) PCT Filed: Apr. 4, 2014

(86) PCT No.: PCT/EP2014/056828

§ 371 (c)(1),
(2) Date: Oct. 26, 2015

(87) PCT Pub. No.: WO2014/173663

PCT Pub. Date: Oct. 30, 2014

(65) Prior Publication Data

US 2016/0102393 A1 Apr. 14, 2016

(30) Foreign Application Priority Data

Apr. 26, 2013 (DE) ..... 10 2013 104 267

(51) Int. Cl.
*C23C 2/00* (2006.01)
*C23C 2/40* (2006.01)
*B05C 3/12* (2006.01)

(52) U.S. Cl.
CPC ..... *C23C 2/003* (2013.01); *B05C 3/125* (2013.01); *C23C 2/40* (2013.01)

(58) Field of Classification Search
None
See application file for complete search history.

(56) References Cited

U.S. PATENT DOCUMENTS

2004/0052959 A1 3/2004 Dauchelle

FOREIGN PATENT DOCUMENTS

EP 1339891 B1 12/2009
JP H04 120258 A 4/1992
(Continued)

OTHER PUBLICATIONS

German Language International Search Report for International patent application No. PCT/EP2014/057058; dated May 20, 2014.
(Continued)

*Primary Examiner* — Charles Capozzi
(74) *Attorney, Agent, or Firm* — Thyssenkrupp North America, Inc.

(57) ABSTRACT

The invention relates to an apparatus for the continuous hot-dip coating of metal strip, preferably steel strip, comprising a melting bath vessel, a snout, which opens in the melting bath vessel, for introducing a metal strip, which is heated in a continuous furnace, into the melting bath in protective gas, and a deflecting roller, which is arranged in the melting bath vessel, for deflecting the metal strip, which is entering the melting bath, in a direction pointing out of the melting bath, wherein that end of the snout which is dipped into the melting bath has at least one runoff chamber which is bounded inward by an overflow wall, downward by a floor and outward by the wall of the snout, wherein the overflow edge of the overflow wall lies at least in sections below the melting bath surface, and wherein a suction line with a pump is connected to the runoff chamber, characterized in that the runoff chamber is provided with at least one through opening through which liquid molten metal can flow out of the
(Continued)

melting bath into the runoff chamber, wherein the at least one through opening is arranged lower than the overflow edge.

16 Claims, 5 Drawing Sheets

(56) References Cited

FOREIGN PATENT DOCUMENTS

| | | | |
|---|---|---|---|
| JP | H05 279827 | A | 10/1993 |
| WO | 02/38825 | A1 | 5/2002 |

OTHER PUBLICATIONS

English translation of International Search Report for International patent application No. PCT/EP2014/057058; dated May 20, 2014.
English translation of the abstract of JP H04 120258 A.
English translation of the abstract of JP H05 279827 A.

APPARATUS FOR THE CONTINUOUS HOT-DIP COATING OF METAL STRIP

CROSS REFERENCE TO RELATED APPLICATIONS

This application is a U.S. National Stage Entry of International Patent Application Serial Number PCT/EP2014/056828, filed Apr. 4, 2014, which claims priority to German patent application no. DE 102013104267.8 filed Apr. 26, 2013, the entire contents of both of which are incorporated herein by reference.

FIELD

The invention relates to an apparatus for the continuous hot-dip coating of metal strip, often referred to as hot-dip galvanizing.

Apparatuses or installations of this type are also referred to as hot-dip galvanizing lines. They are characterized by a continuous method of operation.

BACKGROUND

Known hot-dip coating systems for hot-dipping continuous metal strip often include a melting bath vessel, a snout that opens in the melting bath vessel and is configured to introduce a metal strip that is heated in a continuous furnace into the melting bath in a protective gas. They further include a deflecting roller disposed in the melting bath vessel and configured to deflect the metal strip that enters the melting bath, in a direction pointing out of the melting bath. In the case of prior art hot-dip coating installations, slag which may lead to defects in the coating of the metal strip accumulates on the surface of the molten metal within the snout. During the dipping of the strip, the slag is carried along by the strip and, for example, locations with poor adhesion arise due to slag inclusions and imperfections (uncoated locations) in the coating.

In order to prevent accumulation of slag on the melting bath surface within the snout, JP 04-120258 A proposes, inter alia, to produce within the dipped snout a flow directed counter to the running direction of the metal strip on both sides of the metal strip and, on the melting bath surface, a flow which is directed away from the metal strip and runs in the direction of entry of the metal strip into the melting bath.

An apparatus of the type mentioned at the beginning is known from EP 1 339 891 B1. The snout here is extended, on the dipped lower part thereof, on each side of the metal strip through an inner wall which is oriented toward the surface of the liquid seal bounded by the snout and the upper edge of which lies below said surface. Said inner walls together with the wall of the snout define two outflow spaces for the liquid metal. A pump is connected to the two outflow spaces via suction lines in order to keep the liquid metal level in said spaces to a level below the surface of the liquid seal and therefore to bring about a natural runoff of the liquid metal from said surface to the outflow spaces. For this purpose, the liquid metal level in said outflow spaces is detected and is kept to a level below the surface of the liquid seal in such a manner that the drop height of the liquid metal in the outflow spaces is greater than 50 mm in order to prevent buoyancy of the metal oxide particles and the intermetallic compounds counter to the runoff direction of the liquid metal. In order to make it possible to detect the liquid metal level in the outflow spaces, a reservoir in the form of a container which is open at the top is arranged outside the nozzle, said reservoir being connected via a pipeline to the lower region of each of the outflow spaces, wherein, in each of the outflow spaces, the connection point of the suction line of the pump lies above the connection point of the pipeline connected to the reservoir. The reservoir forms a liquid metal buffer capacity for each of the outflow spaces. In other words, the reservoir together with the outflow spaces forms, via the pipeline, a system of communicating pipes in which the liquid metal level is typically at the same height in each case. The reservoir is equipped here with a liquid metal level detector.

In the case of the apparatus known from EP 1 339 891 B1, considerable difficulties should be expected in industrial use. This is because there may be a shortfall in the required drop height of the liquid metal in the outflow spaces because of necessary snout movements or unavoidable fluctuations of the melting bath surface, which interferes with the outflow of slag directed away from the metal strip and, accordingly, may result in surface defects on the dip-coated metal strip.

The change in the position of the strip in the snout is an important requirement for surface-finished flat steel products. An optimum running of the strip through the melting bath and the blowout jets arranged above same can frequently be realized only by means of an adjustment of the dipped deflecting roller. Furthermore, the proposed solution of level regulation in the outflow spaces by means of reservoir and liquid metal level detector is susceptible to malfunction in industrial use since a considerable formation of slag occurs within the reservoir. The cleaning activity required for removing the slag from the reservoir is unsatisfactory from the point of view of working safety.

SUMMARY

One object of the present disclosure is to provide an improved apparatus for the continuous hot-dip galvanizing of metal strip, in which slag is effectively removed from the interior of the snout of the apparatus and slag-induced surface defects on the surface of the coated metal strip are substantially avoided.

Accordingly, in one aspect of the present disclosure, a hot-dip galvanizing apparatus includes a melting bath vessel, a snout that opens in the melting bath vessel and is configured to introduce a metal strip that is heated in a continuous furnace into the melting bath in a protective gas. They further include a deflecting roller disposed in the melting bath vessel and configured to deflect the metal strip that enters the melting bath, in a direction pointing out of the melting bath. An end of the snout which is dipped into the melting bath has at least one runoff chamber which is bounded inward by an overflow wall, downward by a floor and outward by the wall of the snout, wherein the overflow edge of the overflow wall lies at least in sections below the melting bath surface, and wherein a suction line with a pump is connected to the runoff chamber. The runoff chamber is provided with at least one through opening through which liquid molten metal can flow out of the melting bath into the runoff chamber, wherein the at least one through opening is arranged lower than the overflow edge.

BRIEF DESCRIPTION OF THE DRAWINGS

The present disclosure is described in detail below with reference to the attached drawing figures, wherein.

DETAILED DESCRIPTION

Figure 1:
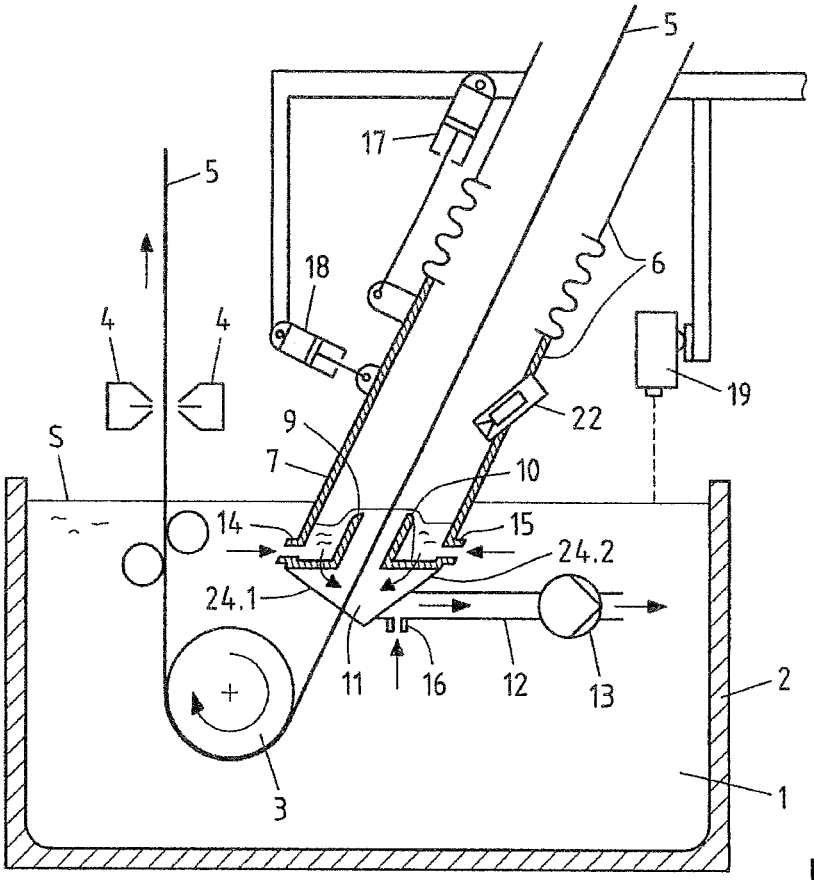
FIG. 1 is a cross-sectional side plan view of an embodiment of an apparatus for the continuous hot-dip galvanizing of metal strip as disclosed herein, in which a snout has an overflow, runoff chamber, a suction line and a pump.

A hot-dip galvanizing apparatus of the present disclosure includes a melting bath vessel, a snout that opens in the melting bath vessel and is configured to introduce a metal strip that is heated in a continuous furnace into the melting bath in a protective gas. They further include a deflecting roller disposed in the melting bath vessel and configured to deflect the metal strip that enters the melting bath, in a direction pointing out of the melting bath. An end of the snout which is dipped into the melting bath has at least one runoff chamber which is bounded inward by an overflow wall, downward by a floor and outward by the wall of the snout, wherein the overflow edge of the overflow wall lies at least in sections below the melting bath surface, and wherein a suction line with a pump is connected to the runoff chamber. The runoff chamber is provided with at least one through opening through which liquid molten metal can flow out of the melting bath into the runoff chamber, wherein the at least one through opening is arranged lower than the overflow edge.

The at least one through opening can also be referred to as a flushing opening and realized, for example, in the form of a bore, a hole cutout, a pipe sleeve or the like.

It is ensured by the present invention, on account of the overflow edge set at least in sections to a position below the melting bath surface and on account of the at least one pump device which is connected to the runoff chamber and pumps liquid coating material out of the runoff chamber, that, in the snout, a surface flow is produced with which slag and impurities flow from the melting bath surface into the runoff chamber and are therefore kept away from the metal strip running into the melting bath. A reliable removal of the slag from the snout is ensured by the at least one through opening (flushing opening) through which liquid molten metal can flow out of the melting bath into the runoff chamber since, by means of the constant supply of liquid molten metal, a "soft" consistency of the slag is maintained and deposits, "encrustations", are very substantially avoided in the snout. This is because, without a sufficient supply of liquid molten metal, the slag particles floating on the melting bath surface in the snout begin to combine with one another in the manner of sintering. The maintaining according to the invention of the soft consistency of the slag, i.e. the substantial prevention of sintering of slag particles, is therefore of advantage, in particular in the case of melts (coating material) based on aluminum.

If the melting bath level in the runoff chamber drops, the volumetric flow of molten metal flowing through the at least one through opening into the runoff chamber automatically increases. By means of this self-stabilizing level regulation, flowing off of slag particles floating on the melting bath surface ("top slag") over the overflow edge into the runoff chamber is ensured irrespective of the drop height of the top slag into the runoff chamber. This gives rise to the following advantages:

- The snout can be pivoted and telescoped without interferences to the removal of the top slag.
- The apparatus according to the invention is insusceptible to unavoidable fluctuations of the melting bath surface, which are produced, for example, by the introduction of blocks of coating material to be melted. A fluctuation of the melting bath surface can even be used in a targeted manner in the case of the apparatus according to the invention in order to loosen firmly encrusted top slag on the inner wall of the snout, which can then be removed via the overflow edge into the runoff chamber.
- The at least one through opening through which liquid molten metal can flow out of the melting bath into the runoff chamber prevents the pump from running dry and stabilizes the operating point thereof.

Preferred and advantageous embodiments of the apparatus according to the invention are specified in the dependent claims.

An advantageous refinement of the apparatus according to the invention is characterized in that the overflow wall is designed in the form of an encircling frame which, together with the wall of the snout, bounds an annular space. This makes it possible to minimize the melting bath surface surrounding the metal strip to be coated in the snout and accordingly the quantity of slag floating in the snout. At the same time, the effect which can be achieved by this is that the slag floating in the snout is removed over a very short distance into the runoff chamber from all locations of the metal strip to be coated.

The runoff chamber is preferably provided with at least two through openings through which liquid molten metal can flow out of the melting bath into the runoff chamber, wherein the respective through opening is arranged lower than the overflow edge, and wherein at least one of the through openings is arranged in the region of the upper side of the metal strip and at least one other of the through openings is arranged in the region of the lower side of the metal strip. The runoff chamber can thereby be more uniformly charged with liquid molten metal from the melting bath. Accordingly, the risk of slag and impurities being deposited in the snout and/or in the runoff chamber is further reduced.

For example, at least one of the through openings can be formed in each case in the wall of the snout in the region of the upper side and/or the lower side of the metal strip and/or in the overflow wall in the region of the upper side and/or the lower side of the metal strip. The at least one through opening or the plurality of through openings is or are preferably provided in the wall of the snout or respectively in the outer wall of the runoff chamber, as a result of which influencing of the flow which surrounds the metal strip at the entry into the melting bath is avoided and the supply of liquid melt from the melting bath into the runoff chamber is ensured.

A further embodiment of the apparatus according to the invention is characterized in that the at least one through opening or at least one of the through openings runs obliquely with respect to the plane of the wall of the snout or obliquely with respect to the plane of the overflow wall. By this means, the flow direction of the molten metal flowing into the runoff chamber via the through opening can be oriented in a targeted manner such that the top slag is assisted in flowing off in the direction of the suction line. The through openings are preferably designed in such a manner that the respective central axis thereof encloses an angle within the range of 5° to 60°, particularly preferably within the range of 10° to 50°, with the axis running perpendicularly with respect to the plane of the snout wall or overflow wall. In particular, the through openings can be formed here by pipe sockets (pipe sleeves) and/or can be provided with guiding elements for guiding the molten metal flowing into the runoff chamber via the through opening. Guiding elements of this type can be, for example, pipe sections, pipe bends or sheetlike guiding elements, for example buffer plates or vanes. The guiding elements can be provided here within the runoff chamber, in particular at the or in the vicinity of the through openings.

A further refinement of the apparatus according to the invention is characterized in that the overflow edge of the overflow wall is rounded in the overflow flow direction. This refinement assists a manner of operation in which top slag and liquid molten metal flow relatively calmly, preferably in as laminar a manner as possible, into the runoff chamber via the overflow edge. A surface flow which is as laminar as possible is desirable in the snout since particles, dust or splashes of melt escaping from the melting bath surface, for example, due to turbulent flows in the protective gas region of the snout, may be deposited on the entering metal strip and may result in coating defects.

According to a further refinement of the apparatus according to the invention, the portion of the overflow wall which runs on the lower side of the metal strip has, on the side facing the wall of the snout, a material enlargement which defines a vertical flank or a flank running with a positive slope in the direction of the snout wall. By this means, an undercut groove which may assist deposition of slag in the runoff chamber is avoided in this region.

According to a further refinement of the apparatus according to the invention, at least one through opening is provided at the lowest point of the runoff chamber or at the start of the suction line, through which liquid molten metal can flow out of the melting bath into the suction line. Dry running of the pump can be reliably prevented as a result.

In order to be able to set an optimum running of the strip through the melting bath and the blow-off nozzles arranged above the melting bath, the snout of the apparatus according to the invention is preferably mounted pivotably and/or movably axially and is provided with at least one setting device for setting the inclination and/or position thereof relative to the melting bath vessel. By means of the setting device, the immersion depth and/or the immersion angle of the snout relative to the melting bath surface can be set. By means of the movement (change in position) of the snout relative to the melting bath surface, the distance of the upper edge of the overflow wall in relation to the melting bath surface can also be set.

In a further embodiment, the setting device and/or the snout can be provided with at least one displacement sensor for sensing a change in position, in particular a change in inclination of the snout and/or of a setting element of the setting device. The setting element can be, for example, a hydraulically or pneumatically actuable setting cylinder or a setting motor, wherein the setting cylinder or setting motor can be coupled to a linkage or gearing attached to the snout. In addition, the melting bath vessel can preferably be assigned a measuring device for measuring the melting bath surface level.

The displacement sensor or the displacement sensors preferably has or have an accuracy of less than ±0.1 mm. By means of the displacement sensor or the plurality of displacement sensors and with the geometry of the snout being taken into consideration, the distance of the upper edge of the overflow wall in relation to the melting bath surface can be determined mathematically on the basis of the actual position and/or a desired position can be predetermined.

The required power of the pump device can be determined and set with reference to a predetermined characteristic on the basis of the known geometry of the snout and melting bath and the determined distance of the upper edge of the overflow wall in relation to the melting bath surface. In this connection, an advantageous refinement of the apparatus according to the invention is characterized in that the apparatus is equipped with a control or regulating device which is designed so as, with reference to a measuring signal of the displacement sensor and a measuring signal of the measuring device measuring the melting bath surface level, to determine a measured variable which is proportional to the height difference between melting bath surface and overflow edge, and which is also designed so as, with reference to said measured variable, to control or to regulate the power of the pump.

The abovementioned characteristic is based on the theoretical overflow volumetric flow which is a function of the height difference between melting bath surface and overflow edge. In a preferred embodiment, for the setting of a stable surface flow into the runoff chamber, an additional volumetric flow which depends on the number and size of the through openings (flushing openings) is taken into consideration in addition to the above theoretical overflow volumetric flow for the definition of the characteristic for controlling the pump. In addition, the position of the through openings is optionally also taken into consideration in the defining of the characteristic.

The pump used in the apparatus according to the invention is preferably a continuously operating pump, for example a centrifugal or spiral pump, wherein the delivery power of the pump can be set, for example, by changing the rotational speed thereof.

In a further refinement of the invention, the pump is connected to a control and/or regulating device which sets the power of the pump to be at least temporarily higher than the volumetric flow of liquid coating material flowing off into the runoff chamber via the overflow edge or higher than the defined characteristic value. Said at least temporary increase (raising) of the pump power is used, for example, at the beginning of the continuous coating process in order to bring the level in the runoff chamber to a lower level than the melting bath surface, as a result of which the surface flow in the snout is improved or intensified in the direction of the runoff chamber.

A further refinement of the apparatus according to the invention is characterized in that the floor of the runoff chamber is arranged with a slope in the direction of the suction line. This assists the removal of slag from the snout.

The apparatus according to the invention can optionally be equipped with monitoring devices for safeguarding the process stability and for documenting the coating process. For example, the snout is preferably provided with an optical camera for observing the melting bath surface within the snout. Furthermore, the runoff chamber is preferably provided with a measuring device, which has a measuring stick, for determining the melting bath surface in the runoff chamber. Furthermore, in a refinement of the apparatus according to the invention, a measuring probe for determining the melting bath surface level is fastened to the end piece of the snout, wherein the measuring probe is preferably provided with a display device which displays the height difference between the melting bath surface and the overflow edge.

The present disclosure is explained in further detail below with reference to the attached drawing figures representing various exemplary embodiments thereof.

A number of exemplary embodiments of an apparatus according to the invention for the hot-dip coating of metal strip, in particular steel strip, are sketched in the drawing. The metal strip 5 is protected against corrosion by the hot-dip coating. For this purpose, the strip 5 is first of all cleaned in a continuous furnace (not shown) and subjected to recrystallization annealing. Subsequently, the strip 5 is subjected to hot-dip finishing by being guided through a molten metal bath 1. As coating material for the strip 5, use is made, for example, of zinc, zinc alloys, aluminum or aluminum alloys. In order to maintain the molten state of the coating metal, the melting bath vessel 2 is electrically heated.

The continuous furnace typically comprises a directly heated preheater and indirectly heated reduction and holding zones, and also downstream cooling zones. A reducing atmosphere of nitrogen and hydrogen is set in the indirectly heated furnace part and in the cooling zones. At the end of the cooling zone, the furnace is connected via a port in the form of a "snout" 6 to the melting bath 1.

A deflecting roller 3 arranged in the melting bath 1 causes the strip 5 entering the melting bath from the snout 6 to be deflected into a preferably vertical direction. On exiting from the melting bath 1, the strip 5 entrains a quantity of coating material from the melting bath, the quantity being dependent on the speed of the strip. The resulting layer thickness of the metal layer is considerably higher than the desired layer thickness. The desired layer thickness is set by means of stripping jets 4.

A common feature of all of the examples, which are illustrated in the drawing, of the apparatus according to the invention for the hot-dip coating of metal strip 5 is that the snout 6, by means of which the strip 5 is introduced into the melting bath 1 in a protective gas atmosphere, has, at its end which is dipped into the melting bath 1, at least one runoff chamber 11 which is bounded inward by an overflow wall 8, downward by a floor and outward by the wall of the snout 6. The overflow wall 8 and the runoff chamber 11 serve for removing slag and impurities which float on the melting bath surface in the snout 6. The overflow edge 9, 10 of the overflow wall 8 is located here at least in sections below the melting bath surface. The overflow edge 9, 10 is preferably of rounded design in the overflow flow direction. A suction line which is provided with a pump 13 is connected to the runoff chamber 11. The outlet of the pump 13 or an outlet line 12 connected to the pump opens in the melting bath 1 below the melting bath surface.

Figure 2:
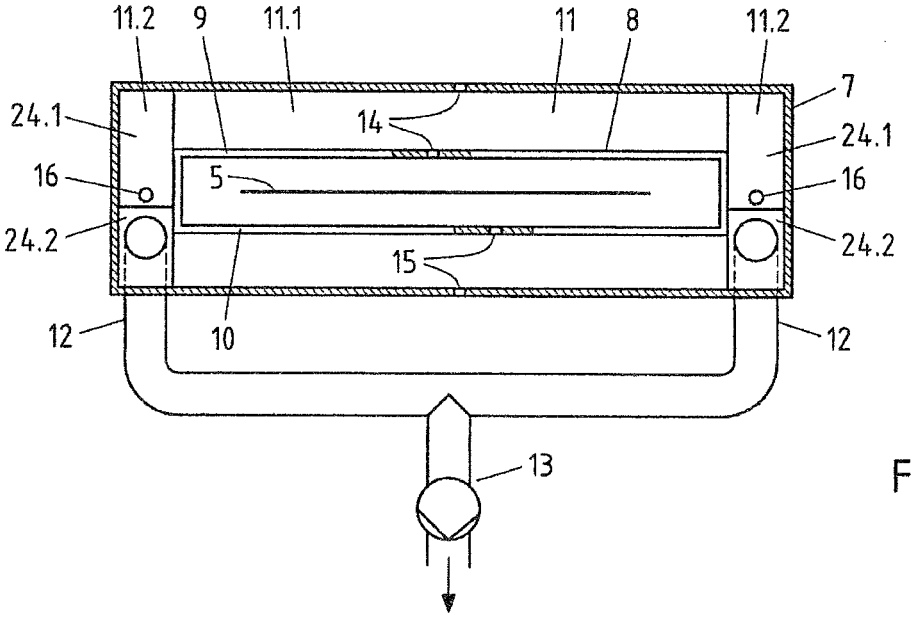
FIG. 2 is a top plan cross-sectional view of the snout end piece, in an alternate embodiment of the apparatus of the present disclosure.

The overflow wall 8 is designed in the form of an encircling frame which, together with the wall of the snout 6, bounds an annular space (cf. FIG. 1 and FIG. 2). The runoff chamber 11 has two elongate chamber sections 11.1 which are spaced apart from each other, run substantially parallel to each other and, at the ends thereof, are connected to each other by two shorter chamber sections 11.2 to form the substantially annular runoff chamber 11. The frame-shaped overflow wall 8 of the runoff chamber 11 bounds the exit opening of the snout 6, through which the strip 5 runs in the direction of the deflecting roller 3. That section of the overflow edge which is on the upper side of the strip is denoted by reference sign 9 and the section on the lower side of the strip by reference sign 10.

The floor of the elongate chamber sections 11.1 is oriented substantially horizontally in the exemplary embodiment sketched in FIG. 1. By contrast, the shorter chamber sections 11.2 each have a depression which is bounded downward by floor sections 24.1, 24.2 butting against each other at an angle. A branch of the suction line 12 opens in each case at one (24.2) of said floor sections, wherein the line branches are brought together in the vicinity of the pump 13. Alternatively to the embodiment illustrated in FIG. 1, the floor of the elongate chamber portions 11.1 can also be formed with a slope with respect to the shorter chamber sections 11.2, which run transversely with respect to the plane of the strip 5.

According to the invention, the runoff chamber 11 is provided with at least one through opening 14, 15 through which liquid molten metal can flow out of the melting bath into the runoff chamber 11, wherein the at least one through opening is arranged lower than the overflow edge 10. In the exemplary embodiment sketched in FIG. 1, at least one through opening 14, 15 is provided in each case in the wall (outer wall) of the snout end piece 7 on the upper side and the lower side of the strip 5. The through openings 14, 15 are arranged above the floor of the runoff chamber 11 and preferably approximately centrally on the elongate runoff chamber sections 11.1. Furthermore, in this example, through openings 16 which serve primarily to prevent dry running of the pump 13 are provided on the lower side of the suction line 12, specifically in the vicinity of the connection points of the line branches to the runoff chamber 11. The through openings 14, 15 and/or 16 are preferably provided with guiding elements in the form of tubular attachments.

The snout 6 is mounted pivotably and movably axially Said snout is provided with a setting device 18 for setting the inclination thereof relative to the melting bath surface or melting bath vessel 2 and with a setting device 17 for changing the axial length or dipped depth thereof. The setting devices 17, 18 and/or the snout 6 are/is provided with displacement sensors (not shown) by means of which a change in position, in particular a change in inclination of the snout 6 and/or of a setting element, for example a piston rod, of the setting device 17, 18 is sensed.

Furthermore, the apparatus illustrated in FIG. 1 is equipped with a measuring device 19 for measuring the melting bath surface level. In addition, a control and/or regulating device is provided which, with reference to the measuring signals of at least one of the displacement sensors and of the measuring device 19 measuring the melting bath surface level, determines a measured variable which is proportional to the height difference between melting bath surface and overflow edge 9, 10, and controls or regulates the power of the pump 13 depending on said measured variable. The displacement sensors preferably have a measuring accuracy of ±0.1 mm.

Furthermore, the snout 6 or the snout end piece 7 is optionally provided with an optical camera 22 for observing the melting bath surface within the snout end piece.

FIG. 2 shows a top view of the horizontally sectioned snout end piece 7 of an apparatus according to the invention with an annular runoff chamber 11 in the running direction of the strip 5. That section 9 of the overflow edge of the frame-shaped overflow wall 8 which is on the upper side of the strip and that section 10 of same which is on the lower side of the strip can be seen. The elongate sections 11.1 of the annular runoff chamber 11 run substantially parallel to the plane of the strip 5 and merge at the ends thereof into the shorter chamber sections 11.2 which are arranged next to the edges of the strip 5. The chamber sections 11.2 running transversely with respect to the plane of the strip 5 preferably each have a depression, the floor of which is formed by floor sections 24.1, 24.2 oriented at an angle to one another (also see FIG. 1). A respective branch of the suction line 12 connected to the pump 13 is connected to the floor section 24.2 on the lower side of the strip. In the exemplary embodiment shown in FIG. 2, the through openings 14, 15 of the runoff chamber 11 are introduced, for example in the form of bores or pipe sockets, on the upper side of the strip and lower side of the strip both into the wall of the snout end piece 7 and into the overflow wall 8 of the runoff chamber 11. The through openings 14, 15 are arranged here in the central region of the elongate chamber sections 11.1. Furthermore, through openings 16 are introduced into the floor of the runoff chamber 11 in the vicinity of the connection points of the suction line 12.

Figure 3:
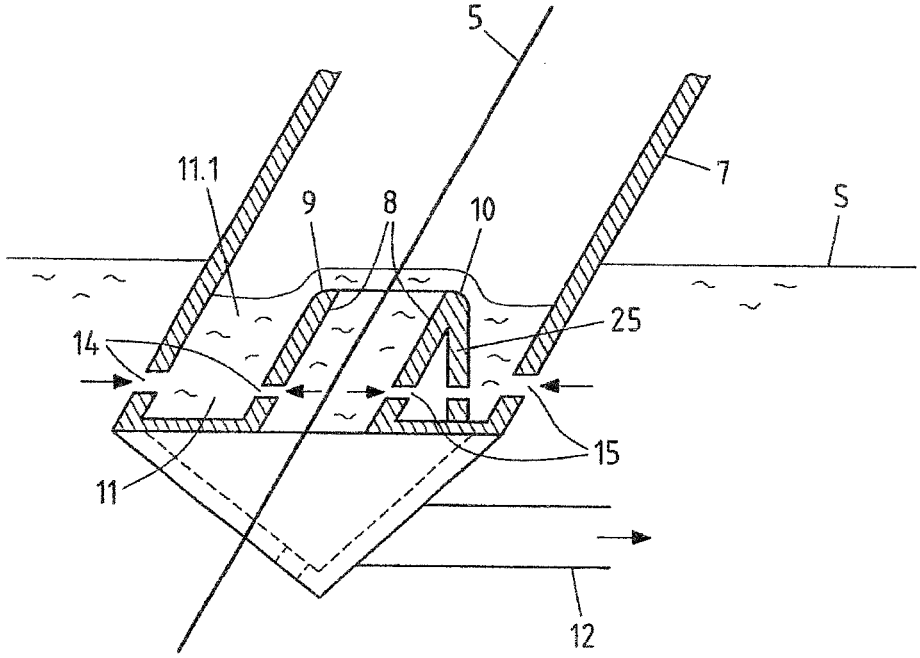
FIG. 3 is a partial cross-sectional side plan view through a snout end piece of an alternate embodiment of an apparatus of the present disclosure.
Figure 4:
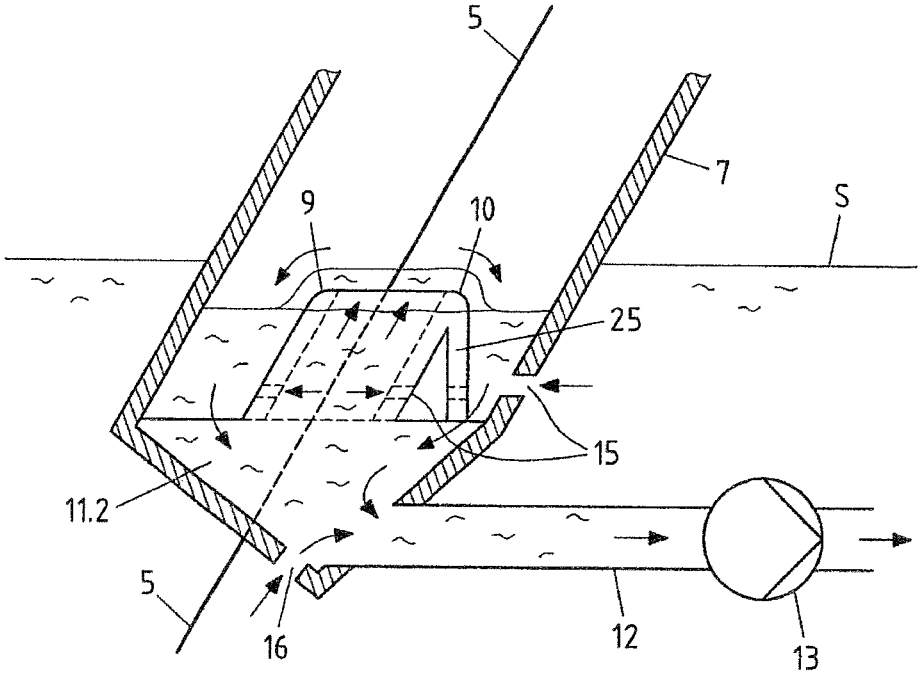
FIG. 4 is a partial cross-sectional side plan view through the snout end piece of FIG. 3, where the suction line opens into the runoff chamber.

FIG. 3 shows a vertical section through the snout end piece 7 of an apparatus according to the invention in the region of the center of the strip. The basic construction of the annular runoff chamber 11 with the frame-shaped inner wall 8 corresponds to the exemplary embodiment shown in FIG. 2. In the exemplary embodiment according to FIG. 3, that section of the overflow wall 8 which runs on the lower side of the strip 5 is additionally provided, on the side facing the wall of the snout end piece 7, with a material enlargement 25 which defines a vertical flank. The material enlargement 25 eliminates or closes an undercut groove between the overflow wall 8 and the floor of the runoff chamber 11. The material enlargement 25 can likewise have a through opening (flushing bore) 15 and can be designed, for example, in the form of a partition. This partition or the additional material 25 avoids a negative slope, i.e. a groove enclosing an acute angle, on that section 10 of the overflow edge which is on the lower side of the strip. The melt flowing over the upper edge 10 can therefore flow off without excessive production of turbulent flows and without peeling from the overflow wall 8, as a result of which loading of the snout atmosphere by dust and other impurities from the melt is substantially avoided or minimized. FIG. 4 likewise shows a vertical section through the snout end piece 7, which is dipped into the melting bath 1, according to FIG. 3, but the section here is placed through the front runoff chamber section 11.2, which runs transversely with respect to the plane of the strip, in the region of the connection point of the suction line 12.

Figure 5:
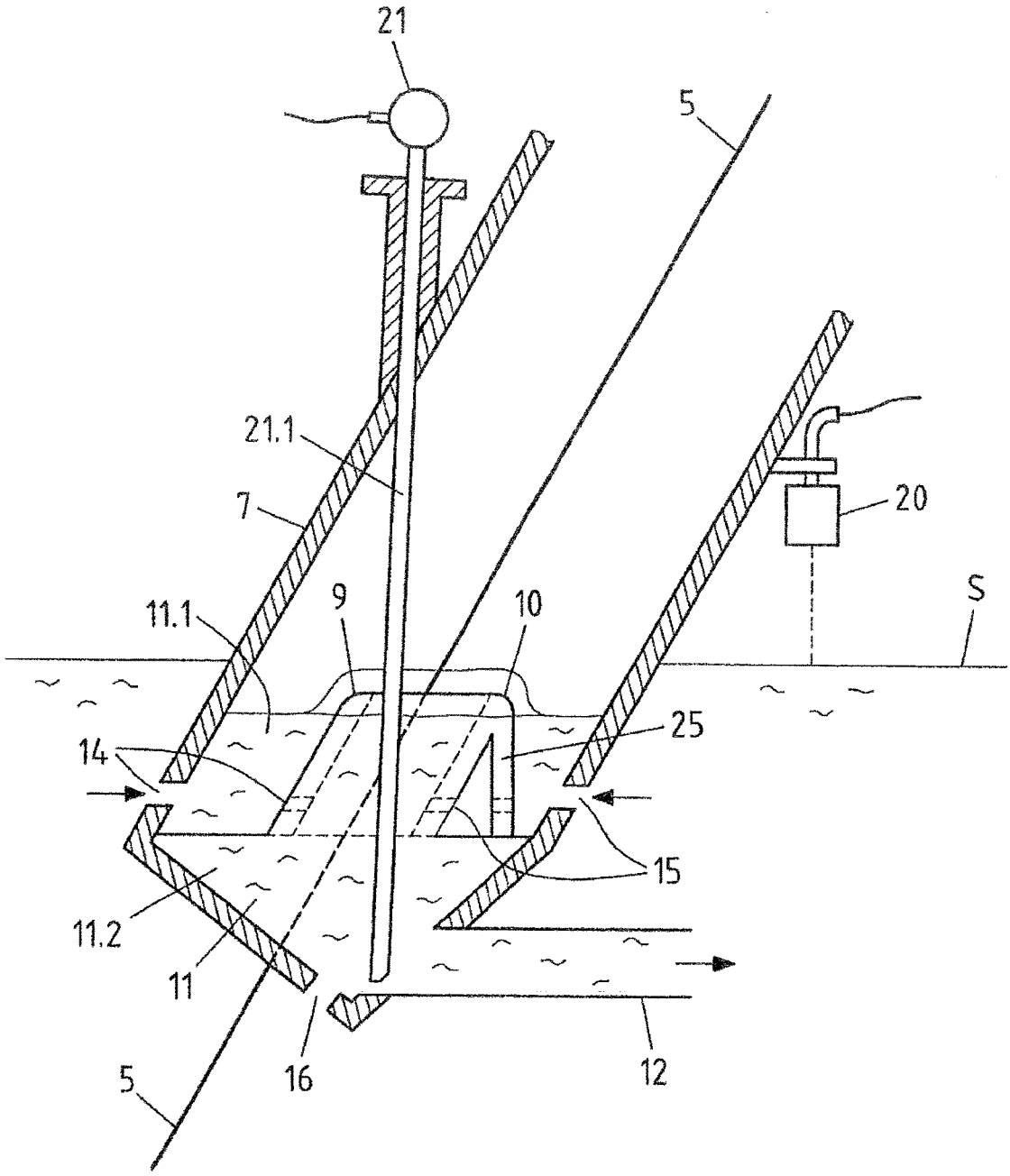
FIG. 5 is a partial cross-sectional side plan view through a snout end piece of an alternate embodiment of an apparatus of the present disclosure.
Figure 6:
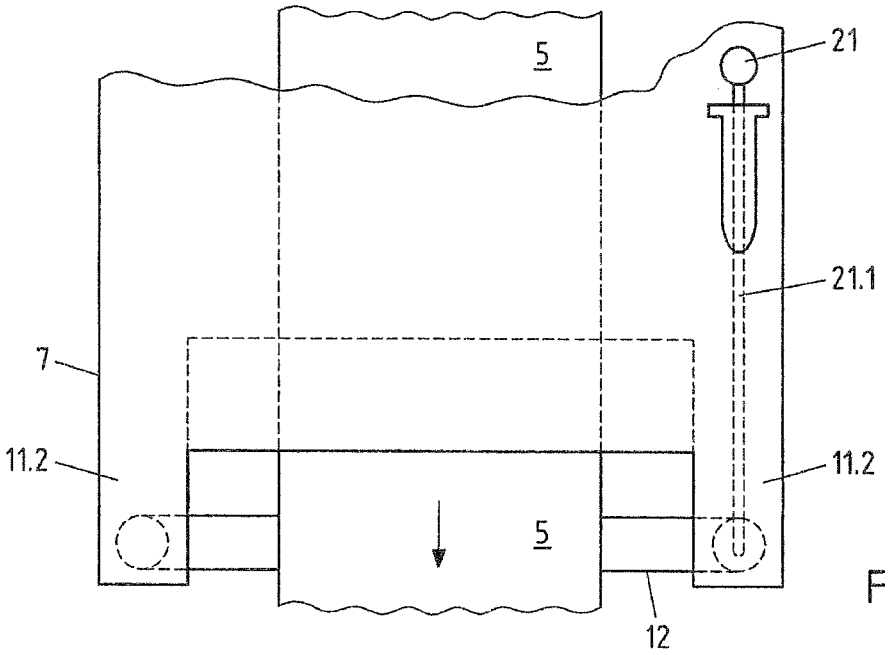
FIG. 6 is a front plan view of the snout end piece of FIG. 5.

FIG. 5 shows a vertical section through the snout end piece 7 of a further exemplary embodiment of an apparatus according to the invention, wherein the section is again placed through the front runoff chamber section 11.2, which runs transversely with respect to the plane of the strip, in the region of the connection point of the suction line 12. In this exemplary embodiment, which substantially corresponds to the example shown in FIGS. 3 and 4, the apparatus according to the invention is additionally provided with monitoring devices. Firstly, the runoff chamber 11 is provided with a measuring device 21, which has a measuring stick, for determining the melting bath surface in the runoff chamber 11. The measuring stick 21.1 can be designed here in the form of a float or can be provided with a float (not shown) at its end dipped into the runoff chamber 11. The melt level in the runoff chamber 11 can be checked by means of the measuring device 21 and therefore dry running of the pump device 12, 13 can be avoided. Furthermore, a measuring probe 20, which is mounted fixedly on the snout 6, is provided for determining the melting bath surface level. The measuring probe 20 is equipped with a display device which displays the height difference between the melting bath surface and the overflow edge 9, 10. The direct coupling of the measuring probe (level measuring device) 20 to the snout 6 makes it possible, taking into account the displacement sensors attached to the setting devices 17, 18, directly and simply to determine and, if necessary, adjust the distance of the overflow edge 9, 10 of the overflow frame 8 from the melting bath surface. FIG. 6 shows a front view of the snout end piece 7 from FIG. 5.

Figure 7:
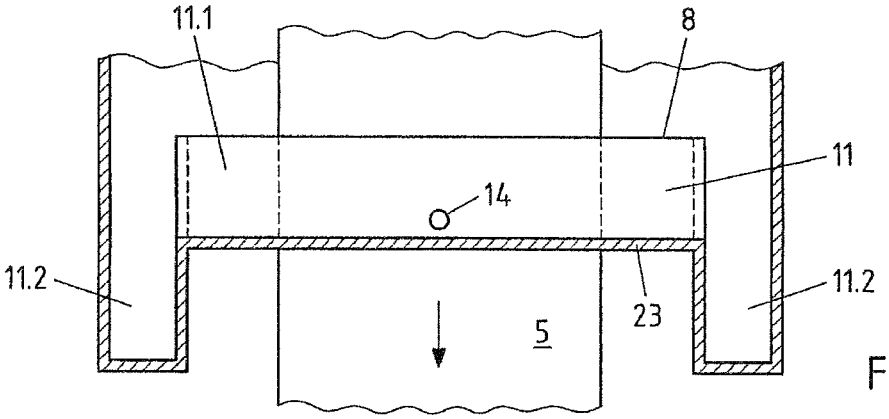
FIG. 7 is a partial cross-sectional front plan view taken through the floor of the runoff chamber of an embodiment of an apparatus of the present disclosure.

FIG. 7 shows a vertical section through the annular runoff chamber 11, wherein the floor 23 of the elongate runoff chamber sections 11.1, which run along the strip 5, is of substantially flat design and runs substantially horizontally.

Figure 8:
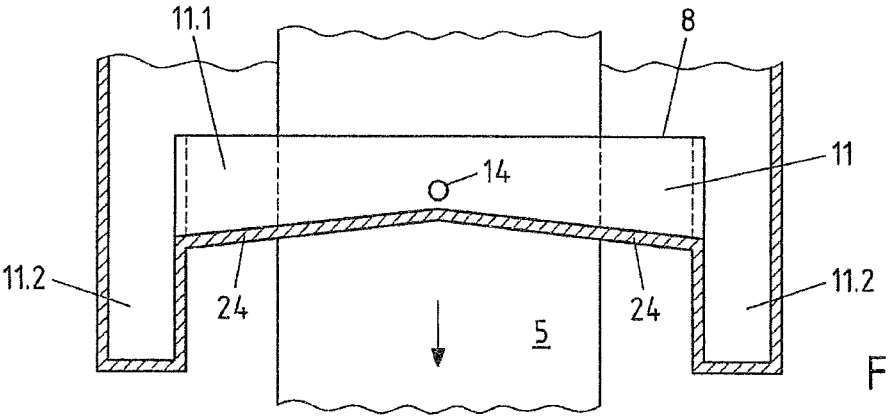
FIG. 8 is a partial cross-sectional front plan view taken through the floor of the runoff chamber of an alternate embodiment of an apparatus of the present disclosure.

The exemplary embodiment illustrated in FIG. 8 differs from that from FIG. 7 in that the floor 24 of the elongate runoff chamber sections 11.1 is in each case designed with a slope from the center in the direction of the runoff chamber sections 11.2, which run transversely with respect to the plane of the strip. The highest point of the floor 24, which has two slope directions, is therefore located approximately in the center of the elongate runoff chamber sections 11.1 or in the center of the strip. The through openings 14 are arranged in the runoff chamber 11 above the apex line of the floor 24. The two-sided slope of the floor 24 assists the removal of the slag or melt overflowing into the runoff chamber 11.

Figure 9:
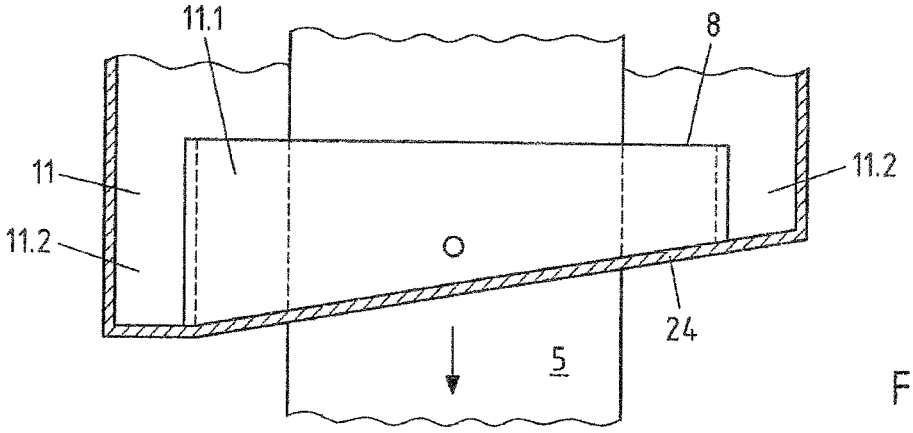
FIG. 9 is a partial cross-sectional front plan view taken through the floor of the runoff chamber of an alternate embodiment of an apparatus of the present disclosure.

The exemplary embodiment illustrated in FIG. 9 differs from the exemplary embodiments of FIGS. 7 and 8 in that the floor 24 of the elongate runoff chamber sections 11.1 is designed with a slope only in the direction of one of the runoff chamber sections 11.2, which run transversely with respect to the plane of the strip. In such a refinement, a single connecting point of the suction line 12, which is connected to the pump 13, at the runoff chamber 11 is sufficient.

Figure 10:
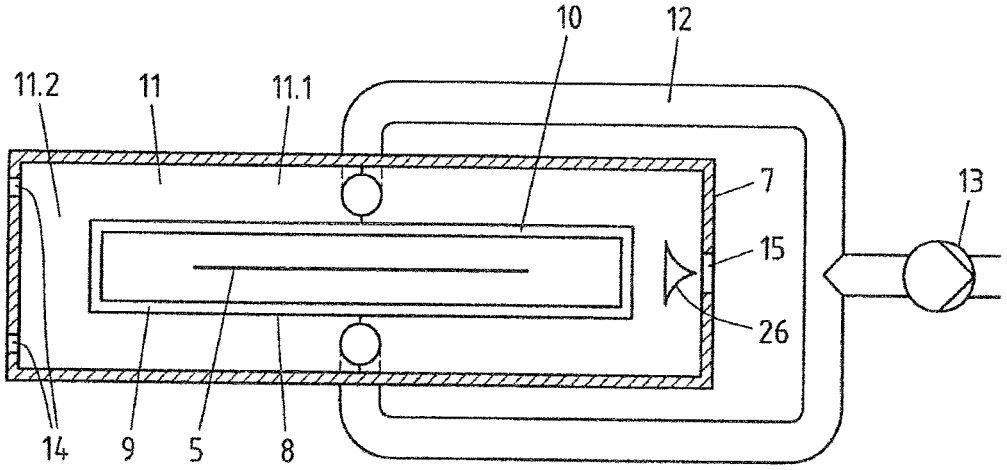
FIG. 10 is a cross-sectional top plan view of an embodiment of a snout end piece of an alternate embodiment of an apparatus of the present disclosure, showing suction lines and a pump connected thereto.

FIG. 10 shows a top view of the horizontally sectioned snout end piece 7 of an apparatus according to the invention with suction line 12 and pump 13. In this embodiment, the floor of the annular runoff chamber 11 is designed dropping toward the center of the elongate runoff chamber sections 11.1 or toward the center of the strip. The two branches of the suction line 12 are connected to the lowest point of the respective elongate section of the runoff chamber 11. The through openings 14, 15 are introduced here into the narrow sides, which run transversely with respect to the plane of the strip, of the outer wall of the snout end piece 7. By way of example, in the right region of the runoff chamber 11, a guiding element 26 is arranged at the through opening 15, by means of which guiding element the melt flowing through the through opening 15 is guided into the runoff chamber 11 in such a manner that slag is prevented from being deposited in regions susceptible thereto (for example, such as the corner regions in this exemplary embodiment).

The invention claimed is:

1. An apparatus for the continuous hot-dip coating of a metal strip, comprising:

a melting bath vessel, a snout, which opens in the melting bath vessel, for introducing a metal strip, which is heated in a continuous furnace, into the melting bath in protective gas, and a deflecting roller, which is arranged in the melting bath vessel, for deflecting the metal strip, which is entering the melting bath, in a direction pointing out of the melting bath, wherein that end of the snout which is dipped into the melting bath has at least one runoff chamber which is bounded inward by an overflow wall, downward by a floor and outward by the wall of the snout, wherein an overflow edge of the overflow wall lies at least in sections below the melting bath surface, and wherein a suction line with a pump is connected to the at least one runoff chamber, characterized in that the at least one runoff chamber is provided with at least one through opening through which liquid molten metal can flow out of the melting bath into the at least one runoff chamber, wherein the at least one through opening is arranged lower than the overflow edge.

2. The apparatus of claim 1, wherein the overflow wall is designed in the form of an encircling frame which, together with the wall of the snout, bounds an annular space.

3. The apparatus of claim 1, wherein the at least one runoff chamber is provided with at least two through openings through which liquid molten metal can flow out of the melting bath into the at least one runoff chamber, wherein the respective through opening is arranged lower than the overflow edge, and wherein at least one of the through openings is arranged in the region of the upper side of the metal strip and at least one other of the through openings is arranged in a region of a lower side of the metal strip.

4. The apparatus of claim 1, wherein at least one of the through openings is formed in the wall of the snout in a region of an upper side and/or a lower side of the metal strip and/or in the overflow wall in a region of an upper side and/or a lower side of the metal strip.

5. The apparatus of claim 1, wherein the at least one through opening or at least one of the through openings runs obliquely with respect to the plane of the wall of the snout or obliquely with respect to the plane of the overflow wall in said snout wall.

6. The apparatus of claim 1, wherein the overflow edge of the overflow wall is rounded in the overflow flow direction.

7. The apparatus of claim 1, wherein a portion of the overflow wall which runs on a lower side of the metal strip has, on a side facing the wall of the snout, a material enlargement which defines a vertical flank or a flank running with a positive slope in the direction of the snout wall.

8. The apparatus of claim 1, wherein at least one through opening is provided at the lowest point of the at least one runoff chamber or at the start of the suction line, through which liquid molten metal can flow out of the melting bath into the suction line.

9. The apparatus of claim 1, wherein the snout is mounted pivotably and/or movably axially and is provided with at least one setting device for setting the inclination and/or position thereof relative to the melting bath vessel.

10. The apparatus of claim 9, wherein the at least one setting device and/or the snout is provided with at least one displacement sensor for sensing a change in position of the snout and/or of a setting element of the setting.

11. The apparatus of claim 9, wherein the melting bath vessel is assigned a measuring device for measuring the melting bath surface level.

12. The apparatus of claim 11, wherein a control or regulating device is provided which is designed so as, with reference to a measuring signal of a displacement sensor and a measuring signal of the measuring device measuring the melting bath surface level, to determine a measured variable which is proportional to the height difference between the melting bath surface and the overflow edge, and which is also designed so as, with reference to said measured variable, to control or to regulate the power of the pump.

13. The apparatus of claim 1, wherein the floor of the at least one runoff chamber is arranged with a slope in the direction of the suction line.

14. The apparatus of claim 1, wherein the snout is provided with an optical camera for observing the melting bath surface within the snout.

15. The apparatus of claim 1, wherein the at least one runoff chamber is provided with a measuring device, which has a measuring stick, for determining the melting bath surface in the at least one runoff chamber.

16. The apparatus of claim 1, wherein a measuring probe for determining the melting bath surface level is fastened to an end piece of the snout, wherein the measuring probe is provided with a display device which displays the height difference between the melting bath surface and the overflow edge.

* * * * *